US005878538A

United States Patent [19]

Rossini

[11] Patent Number: 5,878,538

[45] Date of Patent: Mar. 9, 1999

[54] DEVICE, PARTICULARLY FOR COMPENSATING THE INTERNAL AND EXTERNAL PRESSURES IN A DOUBLE-GLAZING UNIT

[75] Inventor: Mauro Rossini, Este, Italy

[73] Assignee: Finvetro S.r.l., Este, Italy

[21] Appl. No.: 841,992

[22] Filed: Apr. 8, 1997

[30] Foreign Application Priority Data

Apr. 10, 1996 [IT] Italy ..... PD96A0086

[51] Int. Cl.[6] ..... E06B 7/00; E06B 7/12

[52] U.S. Cl. ..... 52/171.3; 52/172; 52/78.13; 52/76.11; 52/788.1; 52/218

[58] Field of Search ..... 52/171.3, 172, 52/786.13, 786.11, 788.1, 218

[56] References Cited

U.S. PATENT DOCUMENTS

| | | | |
|---|---|---|---|
| 4,829,729 | 5/1989 | Derner et al. | 52/171.3 |
| 5,048,245 | 9/1991 | Bresson et al. | 52/171.3 |
| 5,221,363 | 6/1993 | Gillard | 52/173.3 X |
| 5,315,797 | 5/1994 | Glover et al. | 52/786.13 X |
| 5,332,538 | 7/1994 | Levinson et al. | 52/786.13 X |
| 5,394,935 | 3/1995 | Glover | 52/171.3 X |
| 5,608,995 | 3/1997 | Borden | 52/171.3 |
| 5,643,644 | 7/1997 | Demars | 52/786.13 X |

*Primary Examiner*—Carl D. Friedman
*Assistant Examiner*—W. Glenn Edwards
*Attorney, Agent, or Firm*—Guido Modiano; Albert Josif

[57] ABSTRACT

A device, particularly for compensating the internal and external pressures in a double-glazing unit, such double-glazing units comprising a frame which supports two sheets made of at least partially transparent material, a chamber being formed between the two sheets and being adapted to provide an air space for thermal and acoustic insulation. The device comprises a duct which connects the inside of the chamber to the outside environment and is shaped so as to form two siphons arranged in series, a first siphon, located towards the chamber, having a higher head than a second siphon, located towards the outlet of the duct into the outside environment, the device further comprising elements for absorbing the moisture of the air contained in the portion of duct between the siphons.

8 Claims, 2 Drawing Sheets

DEVICE, PARTICULARLY FOR COMPENSATING THE INTERNAL AND EXTERNAL PRESSURES IN A DOUBLE-GLAZING UNIT

BACKGROUND OF THE INVENTION

The present invention relates to a device which is particularly but not exclusively useful for compensating the internal and external pressures in double-glazing units.

Conventional double-glazing units are becoming increasingly widespread in the field of constructions, as well as in other fields, said double-glazing units being particularly appreciated because of their thermal and acoustic insulation features.

All currently commercially available double-glazing units have a substantially common structure despite the variety of their embodiments.

In particular, a double-glazing unit is constituted by a frame which supports two sheets of an at least partially transparent material, between which a chamber is provided which is adapted to form an air space for thermal and acoustic insulation.

This air space, usually filled with isolated air, gives double-glazing units their particular characteristics.

In some particularly advanced double-glazing units, means for blocking sun rays, such as for example blinds, roll-up shutters, Venetian blinds, or others can slide inside the chamber formed by the sheets.

In double-glazing units, one of the two sheets is normally exposed to the outside environment whilst the other one is exposed to the inside environment of the building.

This arrangement of double-glazing units causes them to be in contact with temperatures which are sometimes considerably different from each other.

Moreover, as known, the temperature increases inside the double-glazing unit due to the greenhouse effect when it is struck by the sun rays, indeed because some of the rays are captured and reflected several times between the facing inner and outer surfaces of the two sheets.

These behaviors cause a difference in temperature and especially in pressure between the air inside the chamber formed by the two sheets and the outside pressures.

This pressure gradient causes a significant deformation of the sheets which leads to many drawbacks.

Among these drawbacks, the generation of reflections, which are particularly unpleasant and sometimes dangerous for people outside the building, should be mentioned in the case of reflective sheets for outdoor use.

Another drawback, particularly for double-glazing units in which sliding blocking means are inserted, is the reduction in the functionality of said means, which are prevented from sliding smoothly by the sheet deformations.

Sometimes, in cases in which the deformation of the sheets becomes particularly significant, the darkening means are fully prevented from sliding, thus completely losing their functionality.

In order to eliminate this drawback, valve means have been conceived for compensating the internal and external pressures; however, said means have not yielded satisfactory results, since they exhibit a certain delay in their compensating response when the pressure gradient occurs and increases and also because any air drawn from the outside has a certain moisture degree which is particularly harmful inside the double-glazing unit.

In addition to applying valve means, it is therefore necessary to provide, for this purpose, moisture absorbing means such as hygroscopic salts, which however must also be replaced appropriately, since they quickly saturate, especially in very moist environments.

Another compensation method has been obtained by providing deformation-absorbing regions constituted by membranes made of an elastic material.

In this case, too, the compensating response of the membranes is not ideal, since said membranes move when the pressure gradient is already too high and therefore the sheet is already deformed.

SUMMARY OF THE INVENTION

A principal aim of the present invention is to provide a device, particularly for compensating the internal and external pressures of a double-glazing unit, which solves the above drawbacks of conventional devices, particularly by providing said compensation while preventing water vapor from entering the air space formed by the sheets.

Within the scope of this aim, an object of the present invention is to provide a device which allows a quick compensation which however entails no drawbacks for the various components of the double-glazing unit.

Another object of the present invention is to provide a device which is constructively simple and reliable in operation.

Another object of the present invention is to provide a device which can be adapted to various types of double-glazing units and operates substantially automatically, without forcing the user to perform particular operations for adjustment, control or the like.

Another object of the present invention is to provide a device which can be produced with known technologies and at competitive costs with respect to conventional devices.

This aim, these objects, and others which will become apparent hereinafter are achieved by a device particularly for compensating the internal and external pressures in a double-glazing unit, comprising at least one frame which supports two sheets made of at least partially transparent material, between which a chamber is provided which is adapted to provide an air space for thermal and acoustic insulation, said device being characterized in that it comprises a duct for connecting the inside of said chamber to the outside environment and wherewith two hydraulic closure valves are associated in series, means being provided for absorbing the moisture of the air contained in the duct portion between said valves.

Advantageously, said hydraulic closure valves are two siphons: a first siphon, located towards said chamber, has a greater head than the second siphon, which is arranged towards the outlet of said duct leading into the outside environment.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
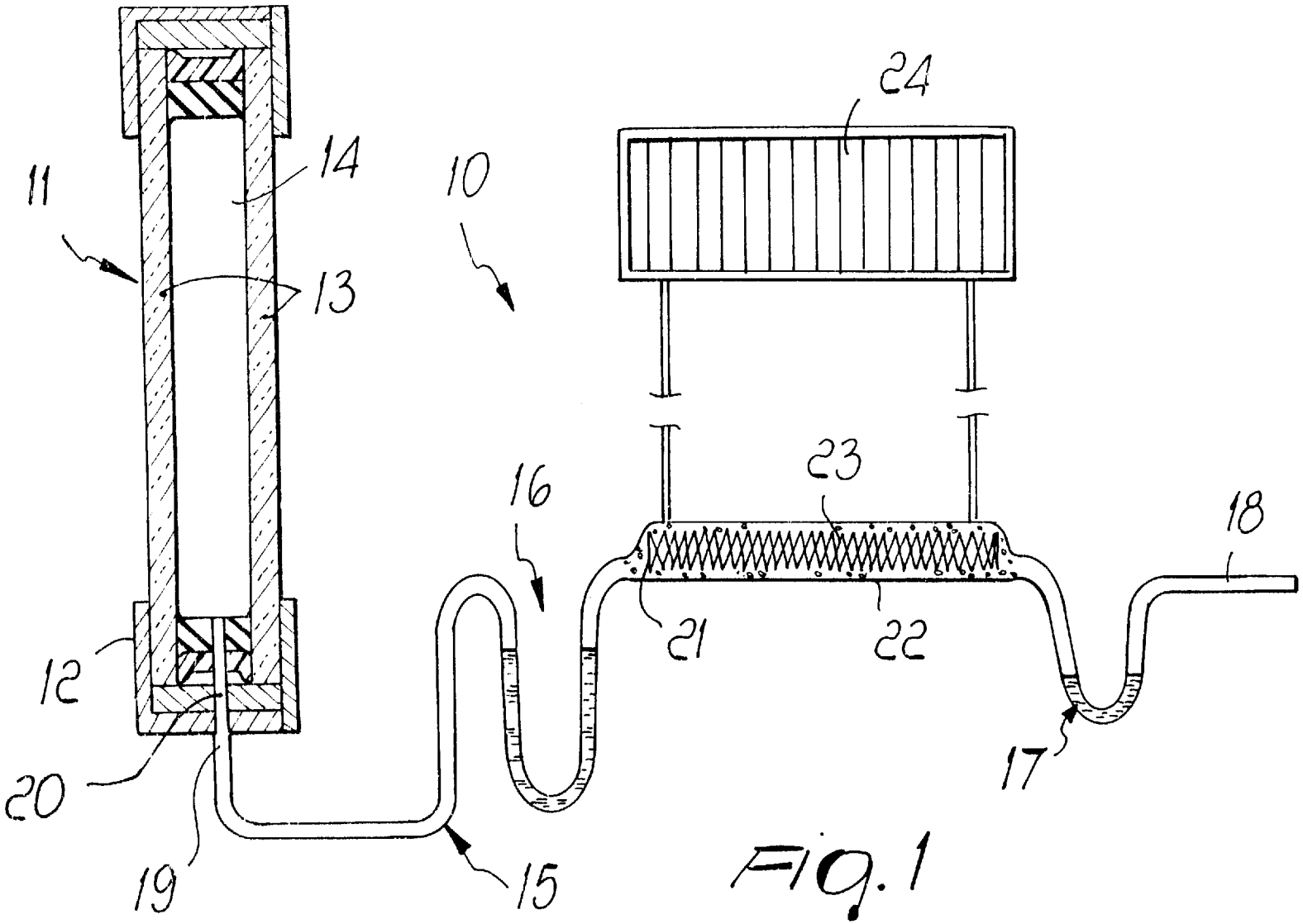
FIG. 1 is a schematic and partially sectional orthographic projection view of a device according to the present invention.
Figure 2:
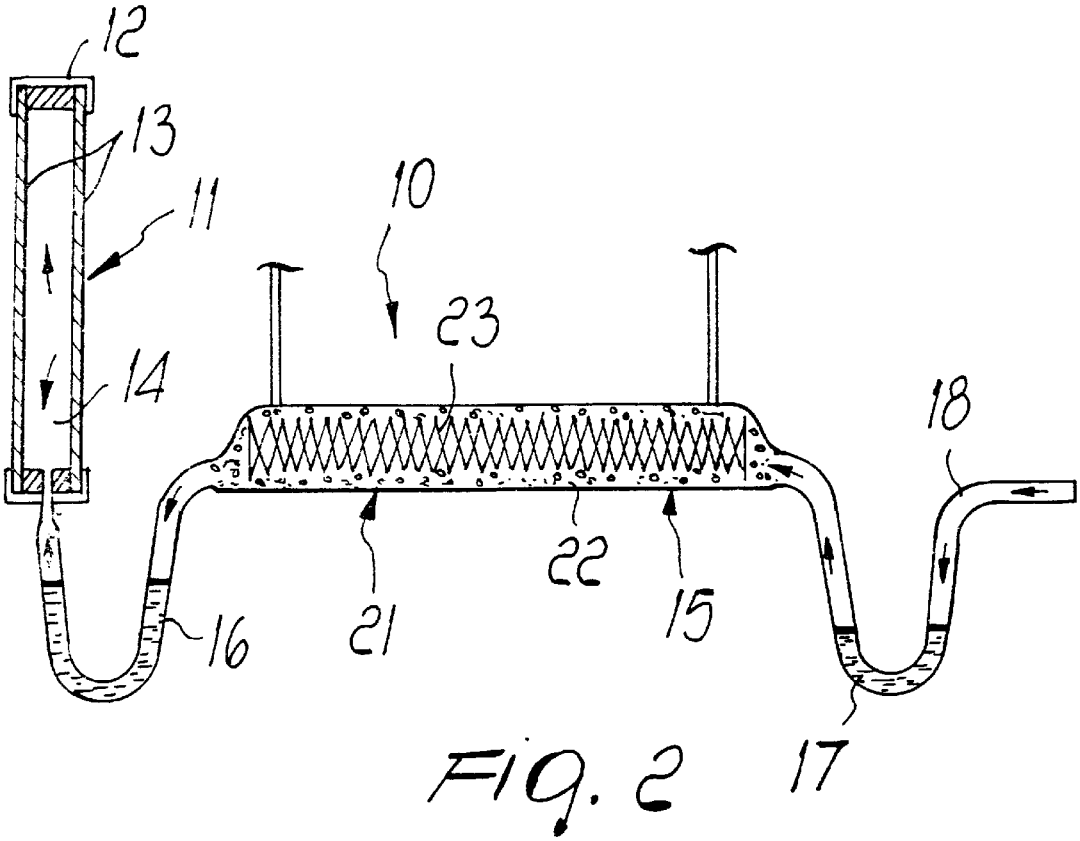
FIGS. 2 and 3 are views of the device of FIG. 1 in two different operative steps.
Figure 3:
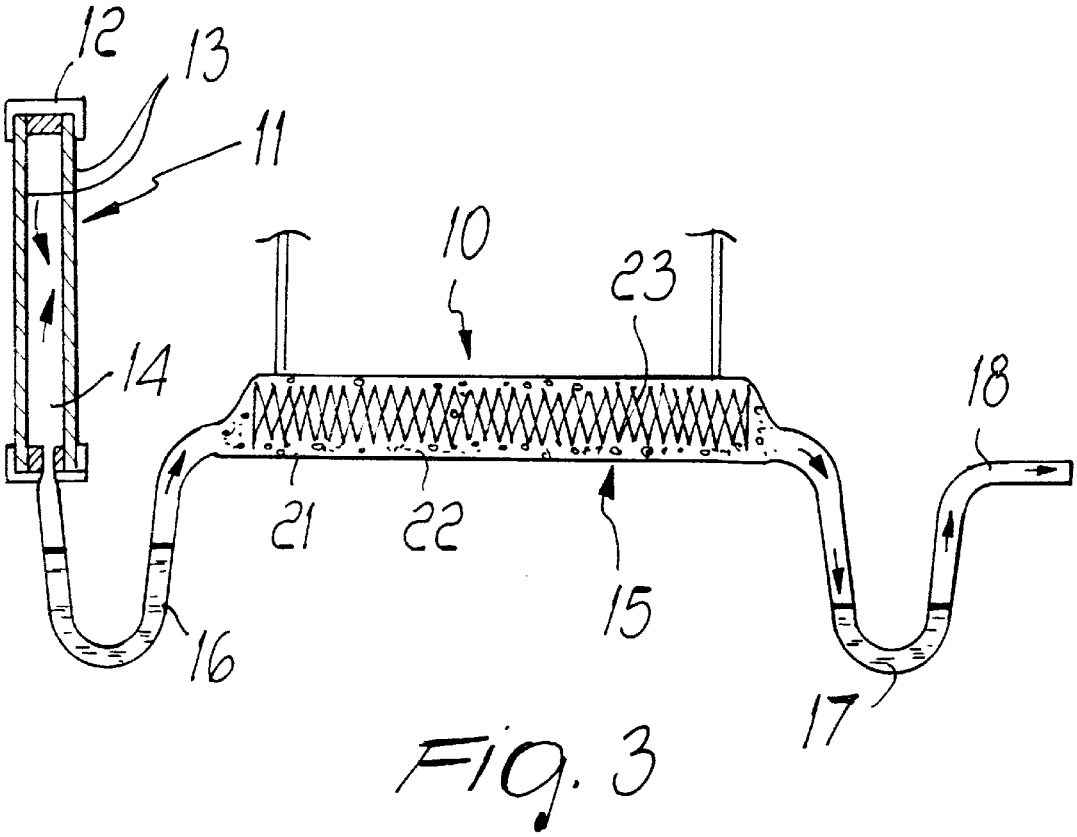

With particular reference to FIGS. 1 to 3, a device particularly for compensating the internal and external pressures in a double-glazing unit, according to the invention, is generally designated by the reference numeral 10.

The device 10 is in this case applied to a double-glazing unit, generally designated by the reference numeral 11.

The double-glazing unit 11 comprises a frame 12 supporting two sheets 13 made of at least partially transparent material, between which a chamber 14 is provided which is adapted to provide a thermal and acoustic insulation air space.

The device 10 comprises a duct 15, connecting the inside of the chamber 14 to the outside environment and shaped so as to form, in a series arrangement, two hydraulic closure valves, particularly two siphons in the case being considered.

More specifically, a first siphon, designated by the reference numeral 16 and arranged towards the chamber 14, has a greater head than a second siphon, designated by the reference numeral 17, which is arranged towards the outlet, designated by the reference numeral 18, of the duct 15 which leads into the outside environment.

Moreover, in this case the duct 15 has an end 19 associated with another through duct 20, which is formed in the frame 12 and is adapted to connect the inside of the chamber 14 to said duct 15.

A liquid which does not evaporate in the operating temperature range of the device 10 is placed inside the first siphon 16 and inside the second siphon 17 in this case (merely by way of example, natural or mineral oil can be used as a liquid).

The device 10 also comprises means for absorbing the moisture of the air contained in a duct portion 21 between the two siphons 16 and 17.

The duct portion 21, in this case, has a larger cross-section than the rest of the duct 15, and the moisture-absorbing means are constituted by hygroscopic salts placed therein and generally designated by the reference numeral 22.

The hygroscopic salts 22 are per se known and are commonly commercially available.

In order to avoid the need to regenerate the hygroscopic salts 22 once they have become saturated, the device 10 comprises means for desiccating said salts which in this case are constituted by an electrical resistor 23, supplied by power supply means constituted, again in this case, by a photovoltaic cell 24.

In practice, operation of the device 10 is as follows: when, because of a plurality of environmental circumstances, the pressure of the outside atmosphere is higher than the pressure inside the chamber 14, the second siphon 17 is affected by the pressure imbalance and the liquid contained therein has a higher level in the branch arranged towards the chamber 14.

If said pressure gradient persists and increases, the liquid level in the branch subjected to negative pressure continues to increase until the emptying of the other branch allows the outside air to bubble through the liquid and accordingly through the duct portion 21.

When the air, having a certain moisture degree, passes through the duct portion 21, contact with the hygroscopic salts 22 allows to absorb said moisture, so that the air, deprived of its moisture, can enter the chamber 14, compensating the pressure which is present therein with respect to the outside pressure, if the first siphon 16 is also passed by bubbling through.

If, because of various environmental situations, the pressure inside the double-glazing unit 11 is instead higher than outside, the air, in a manner which is fully similar to the one described for suction from the outside except for the opposite direction of flow, is expelled after passing by bubbling through the first siphon 16 and then through the second siphon 17.

If the salts 22 become saturated, activation of the electrical resistor 23, which can be provided by a timer or manually, allows to desiccate said salts, and the overpressure generated by their evaporation can be easily discharged through the second siphon 17.

On the other hand, discharge of the moisture generated by the desiccation of the hygroscopic salts 22 cannot in any way occur towards the inside of the chamber 14, since, as previously described, the first siphon 16 has a higher head than the second siphon 17 and therefore, following the principle of lesser resistance, the air and the moisture associated therewith discharge through the path offering less resistance (in the specific case, the path offering less counterpressure), which is indeed the path of the second siphon 17.

In practice it has been observed that the present invention has achieved its intended aim and objects.

In particular, it should be noted that the device according to the present invention allows to reliably compensate the pressure difference without however requiring the user to perform any particular adjustments or control of the compensation process.

It should also be noted that the device according to the present invention is particularly safe and effective and requires minimal maintenance, since substantially automatic or semiautomatic desiccation and consequent regeneration of the hygroscopic salts can be achieved.

It should also be noted that the present invention can be applied to various types of double-glazing units and to double-glazing units which may have already been installed.

The present invention is susceptible of numerous modifications and variations, all of which are within the scope of the inventive concept.

The details may also be replaced with other technically equivalent elements.

The materials employed and the dimensions may be any according to requirements.

What is claimed is:

1. A combination of a double-glazing unit and a pressure compensation device for compensating the internal and external pressures between an inside space of the double-glazing unit and the outside environment, said double-glazing unit comprising:

at least one frame;

two sheets made of at least partially transparent material, said sheets being supported by said frame; and a chamber being formed between said two sheets so as to provide an air space for thermal and acoustic insulation;

said pressure compensation device comprising:

a duct connecting the inside space of said chamber to the outside environment such that said chamber is substantially completely sealed by said frame and the inside space of said chamber is substantially exclusively in air-flow communication with the outside environment only through said duct;

two hydraulic closure valves connected in series with said duct such that when the pressure inside said chamber is sufficiently less than the pressure of the outside environment said closure valves automatically permit air from the outside environment to pass through said closure valves and into said chamber for stabilizing an equilibrium condition for decreasing the difference between the pressure inside said chamber and the pressure of the outside environment, and such that when the pressure inside said chamber is sufficiently greater than the pressure of the outside environment said closure valves automatically permit air from the chamber to pass through said closure valves and into the outside environment for stabilizing the equilibrium condition for decreasing the difference between the pressure inside said chamber and the pressure of the outside environment, and such that in the equilibrium condition said closure valves completely seal said chamber from the outside environment whereby air is not permitted to flow through said closure valves between said chamber and the outside environment;

a duct portion delimited on said duct arranged between said two valves; and absorbing means for absorbing moisture of air which flows through said duct portion for reducing the moisture in the air which flows from the outside environment through said closure valves and said duct portion and into said chamber.

2. The combination of claim 1, wherein said hydraulic closure valves are a first siphon and a second siphon, arranged respectively on said duct at a fist end of said duct towards said chamber and at a second opposite end of the duct towards outlet to the outside environment, said first siphon having a higher head than the second siphon, said absorbing means being contained in said duct portion between said siphons.

3. The combination of claim 2, wherein said duct has a larger cross-section in said duct portion located between said two siphons than in portions of said duct arranged adjacent said chamber and adjacent the outside environment.

4. The combination of claim 3, wherein said moisture-absorbing means are constituted by hygroscopic salts.

5. The combination of claim 4, further comprising means for desiccating said hygroscopic salts.

6. The combination of claim 5, wherein said desiccating means comprises an electrical resistor, said electrical resistor being immersed in said salts, a power supply means being further provided for supplying energy to said electrical resistor.

7. The combination of claim 6, wherein said power supply means comprises at least one panel with photovoltaic cells.

8. The combination of claim 1 comprising a through duct formed in said frame, said through duct connecting said duct to the inside of said chamber.

* * * * *